US007625522B2

(12) United States Patent
Cooper

(10) Patent No.: US 7,625,522 B2
(45) Date of Patent: Dec. 1, 2009

(54) METHOD AND APPARATUS FOR FORMING A HOLE OR SLOT IN POWDER METAL COMPONENTS

(75) Inventor: Donald D. Cooper, Fond du Lac, WI (US)

(73) Assignee: GKN Sinter Metals, Inc., Germantown, WI (US)

( * ) Notice: Subject to any disclaimer, the term of this patent is extended or adjusted under 35 U.S.C. 154(b) by 370 days.

(21) Appl. No.: 10/559,699

(22) PCT Filed: Jun. 9, 2004

(86) PCT No.: PCT/US2004/018245

§ 371 (c)(1),
(2), (4) Date: Jul. 6, 2006

(87) PCT Pub. No.: WO2004/112996

PCT Pub. Date: Dec. 29, 2004

(65) Prior Publication Data

US 2006/0280641 A1 Dec. 14, 2006

Related U.S. Application Data

(60) Provisional application No. 60/477,264, filed on Jun. 10, 2003.

(51) Int. Cl.
*B22F 1/02* (2006.01)

(52) U.S. Cl. ..... 419/38; 428/78

(58) Field of Classification Search ..... 419/38
See application file for complete search history.

(56) References Cited

U.S. PATENT DOCUMENTS

| | | | | |
|---|---|---|---|---|
| 4,087,221 | A * | 5/1978 | Munson et al. | 425/78 |
| 5,039,292 | A | 8/1991 | Tanigawa et al. | |
| 5,378,416 | A | 1/1995 | Kishi et al. | |
| 5,403,373 | A | 4/1995 | Kitagawa et al. | |
| 5,698,149 | A * | 12/1997 | Hinzmann et al. | 264/120 |
| 6,080,358 | A | 6/2000 | Oba et al. | |

FOREIGN PATENT DOCUMENTS

| | | | |
|---|---|---|---|
| EP | 1228827 | A1 | 8/2002 |
| JP | 60063301 | A * | 4/1985 |
| JP | H06-246497 | | 9/1994 |
| JP | H07-148597 | | 6/1995 |
| JP | H10-128595 | | 5/1998 |
| JP | H10-146695 | | 6/1998 |
| JP | 2000-071099 | | 3/2000 |

OTHER PUBLICATIONS

Translation of "Notice of Reasons for Rejection" re: Japanese Patent Application No. 2006-533627, Jul. 27, 2009.
International Search Report and Written Opinion Under Date of Mailing of Nov. 22, 2004, in connection with International Patent Application No. PCT/US2004/018245.

* cited by examiner

*Primary Examiner*—Roy King
*Assistant Examiner*—Christopher Kessler
(74) *Attorney, Agent, or Firm*—Quarles & Brady LLP

(57) ABSTRACT

One or more holes that extend through a wall of a powder metal component are formed by creating an absence of powder metal in a die set during compaction at an interface between a side surface of a punch and another side surface of the die set that faces the side surface of the punch in substantially close proximity to create the absence of powder metal at the interface.

11 Claims, 8 Drawing Sheets

METHOD AND APPARATUS FOR FORMING A HOLE OR SLOT IN POWDER METAL COMPONENTS

CROSS-REFERENCE TO RELATED APPLICATION

This application claims the benefit of U.S. Provisional Application No. 60/477,264 filed Jun. 10, 2003.

STATEMENT CONCERNING FEDERALLY SPONSORED RESEARCH OR DEVELOPMENT

Not applicable.

FIELD OF THE INVENTION

This invention relates to powder metal (PM) components, and in particular to forming holes and slots that extend through a wall of a powder metal component.

BACKGROUND OF THE INVENTION

FIGS. 1*a-c* illustrate examples of prior art powder metal components having holes formed in directions orthogonal to the direction of pressing. Typically, but not always, the direction of pressing is vertical. Therefore, the holes in FIGS. 1*a-c* would be running with their axes horizontal when being vertically pressed. The use of "vertical" and "horizontal" as used herein is not intended as limiting in orientation, only to communicate that the two directions are orthogonal to one another, or that "horizontal" is orthogonal to the direction of pressing, regardless of whether the direction of pressing is aligned with the direction of gravity or not.

Component 10 in FIG. 1*a*, component 15 in FIG. 1(*b*) and component 20 in FIG. 1*c* represent three of many possible configurations of metal components where the final component requirements dictate the necessity of horizontal holes or slots through the part. In prior methods of producing a powder metal component, the requirement for horizontal holes or slots required additional processes to form the hole or slot. Common prior methods of providing horizontal holes or slots in powder metal components added additional manufacturing processes, known as secondary manufacturing processes, to form the holes or slots. These additional manufacturing processes included drilling, punch piercing or cutting by milling, heat deformation cutting, plasma cutting or other hole or slot forming metal removal processes.

There are several disadvantages to the previous processes of hole or slot creation in powder metal components. These include the additional capital equipment and expenditure required for the additional manufacturing step, the additional time required for completing the added manufacturing step, the added risk one or more holes or slots are missed in being created during the secondary process, the additional handling and storage required in the secondary processes, the scrap that is created from the secondary processes, and the additional labor and maintenance costs involved with the secondary processes.

The cost of the additional processes required to produce the holes or slots often would make the powder metal process for forming the part cost prohibitive. The parts might not even be quoted due to the necessity of these features. Unfortunately this resulted in the loss of many of the advantages of components being produced by the powder metal process, such as the ability to produce complex shapes with close tolerances.

SUMMARY OF THE INVENTION

In the present invention the powder metal component is compacted in a pressing direction and a combination of die and other tooling members interact in a fashion during the pressing cycle to form holes or slots in the compacted component that run through a wall of the component in a direction that is orthogonal to the pressing direction. With the horizontal holes or slots being formed during the pressing motion, the need for other hole or slot forming manufacturing processes can be eliminated.

Such openings are formed by creating an absence of powder metal in a die set during compaction at an interface between side surfaces of the tooling members in substantially close proximity to create the absence of powder metal at the interface.

The foregoing and other objects and advantages of the invention will appear in the detailed description which follows. In the description, reference is made to the accompanying drawings which illustrate a preferred embodiment of the invention.

DETAILED DESCRIPTION OF THE PREFERRED EMBODIMENT

Figure 1A:
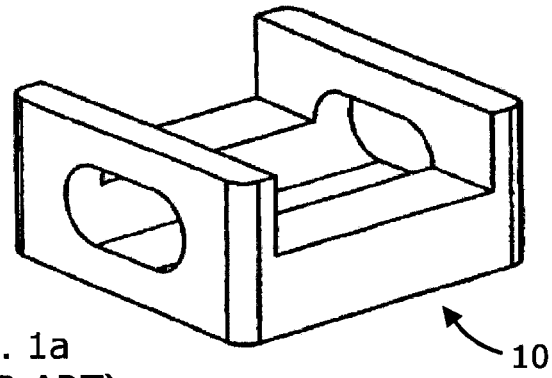
FIG. 1a (PRIOR ART)
FIG. 1*a* is a perspective view of a prior art powder metal component having a slot that runs through end walls of the component orthogonal to the direction of pressing.
Figure 1B:
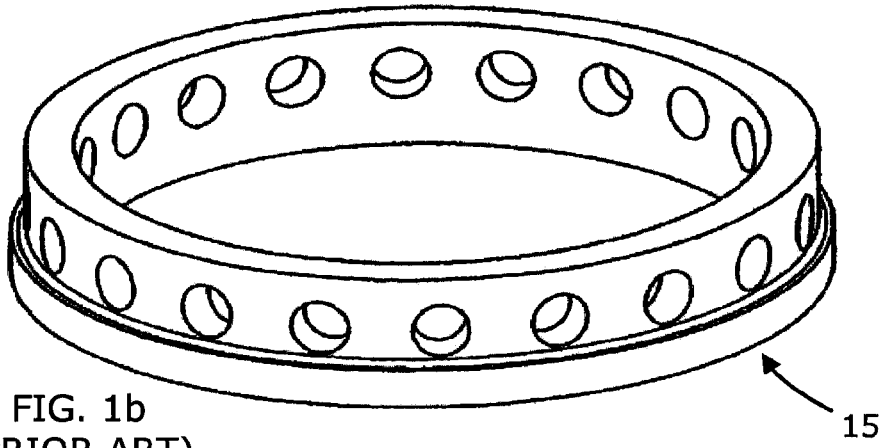
FIG. 1b (PRIOR ART)
FIG. 1*b* is a bottom perspective view of a prior art powder metal component having holes through a wall of the component that run orthogonal to the direction of pressing.
Figure 1C:
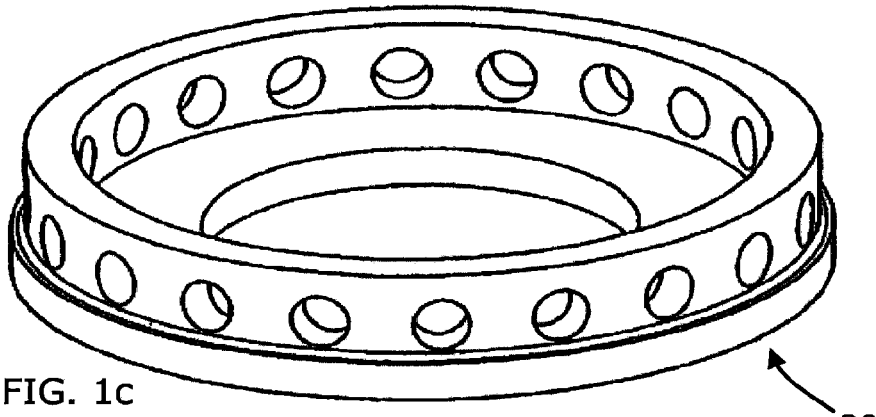
FIG. 1c (PRIOR ART)
FIG. 1*c* is a view like FIG. 2 of a different powder metal component having holes through a wall of the component that run orthogonal to the direction of pressing.
Figure 2A:
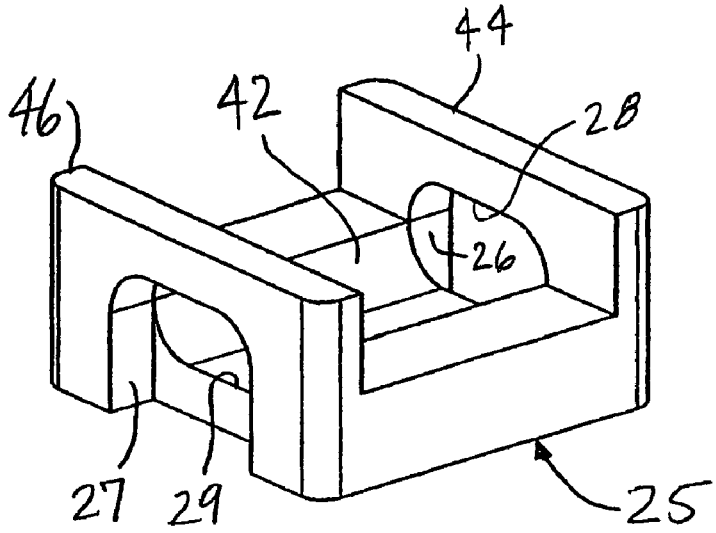
FIG. 2*a* is a perspective view of the component of FIG. 1*a* redesigned to incorporate the invention.
Figure 2B:
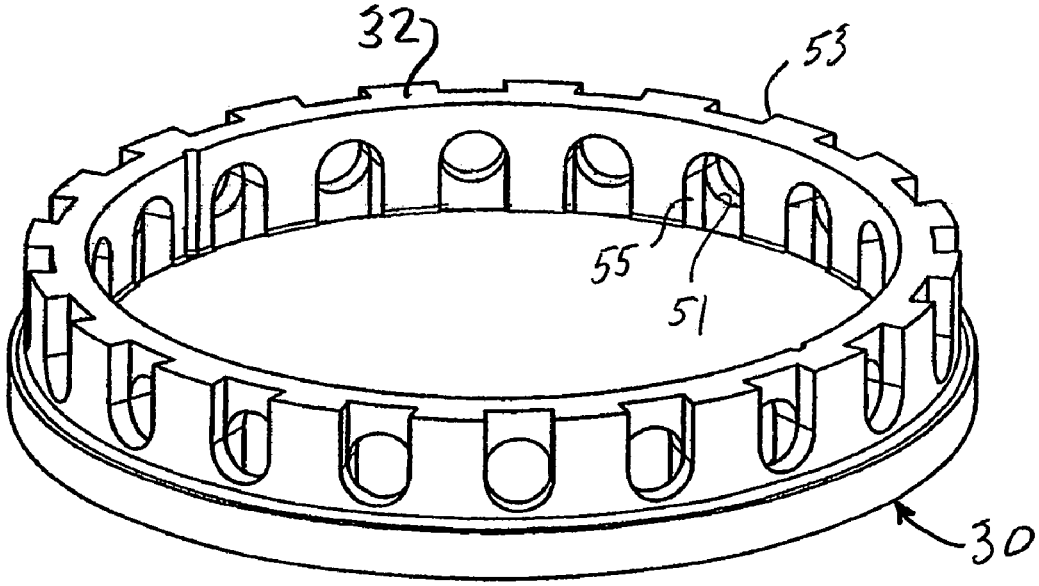
FIG. 2*b* is a bottom perspective view of the component of FIG. 1*b* redesigned to incorporate the invention.
Figure 2C:
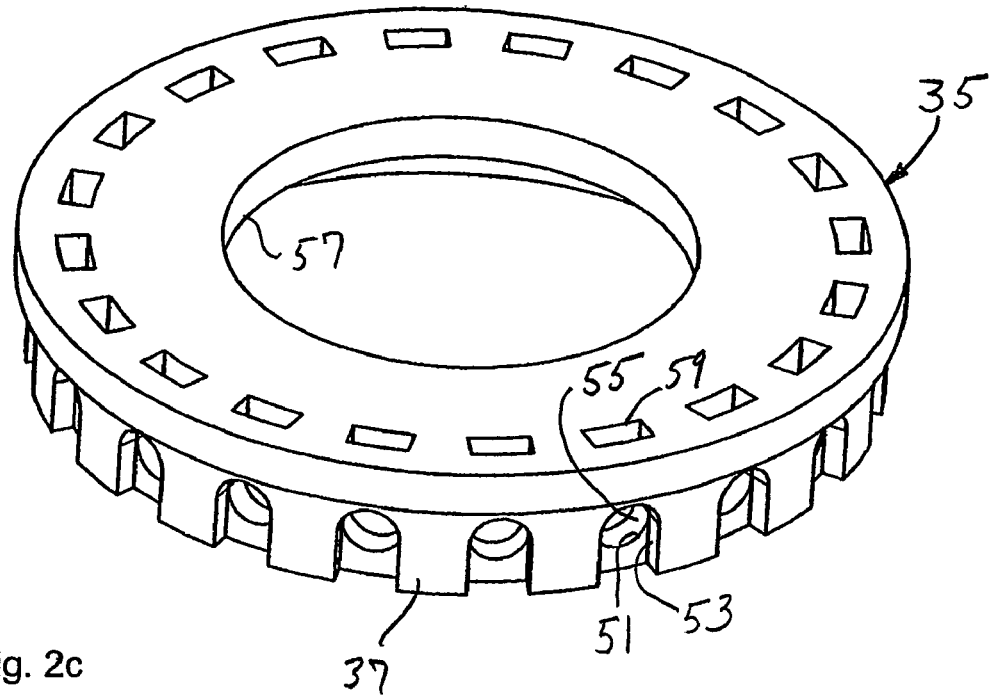
FIG. 2*c* is a top perspective view of the component of FIG. 1*c* redesigned to incorporate the invention.
Figure 2D:
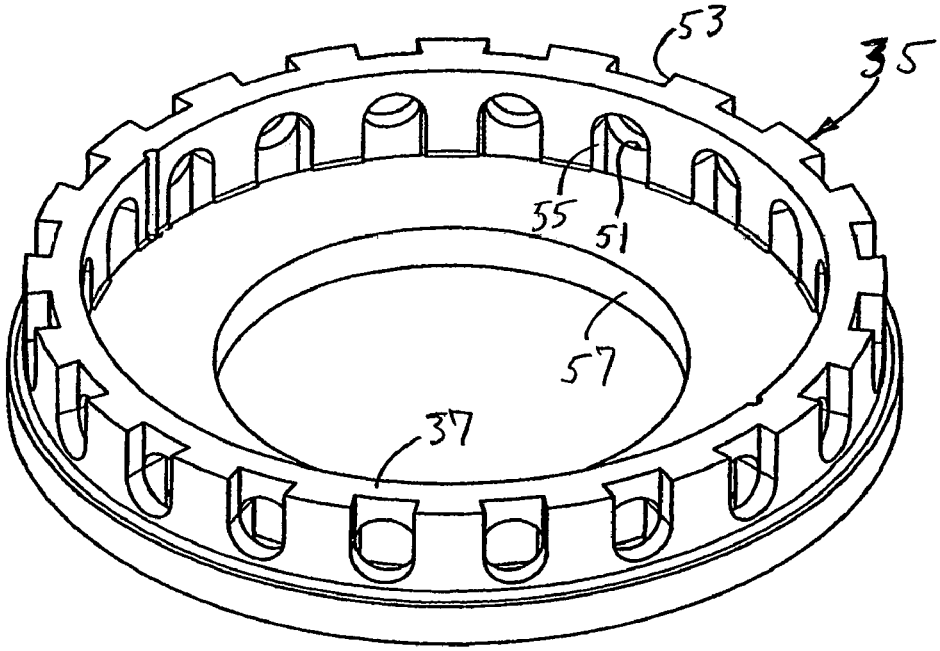
FIG. 2*d* is a top perspective view of the component of FIG. 1*c* redesigned to incorporate the invention.

In accordance with the present invention the horizontal holes or slots are created during the pressing cycle. As shown in FIG. 2*b* through 2*d* the new process is applicable to the manufacture of complex components 30 and 35 having holes 51 that extend axially through peripheral walls 32. The process is illustrated in FIGS. 3*a-d* being performed to make a simple component 25 as illustrated FIGS. 2*a* and 4, forming a simple horizontal slot 42 that that meets slots 26 and 27 at respective holes 28 and 29 in the respective end walls 44 and 46 of the component 25.

As shown in FIGS. 3*a-d*, the simple component 25 can be made according to the invention using a powder compaction tooling die set that includes a die 101, upper tooling members 221 and 231, and lower tooling members 351, 361 and 371. The upper and lower tooling members may also be referred to as punches. The die 101 and tooling members 221, 351, 361 and 371 are moved by mechanical, hydraulic or other means of power when installed in a powder metal compacting press.

The starting position is shown in FIG. 3(*a*). In this position, the die 101 is aligned with the lower tooling members 351, 361, and 371 and the lower tooling members 351, 361, and 371 all have their upper surfaces level with one another.

Figure 3A:
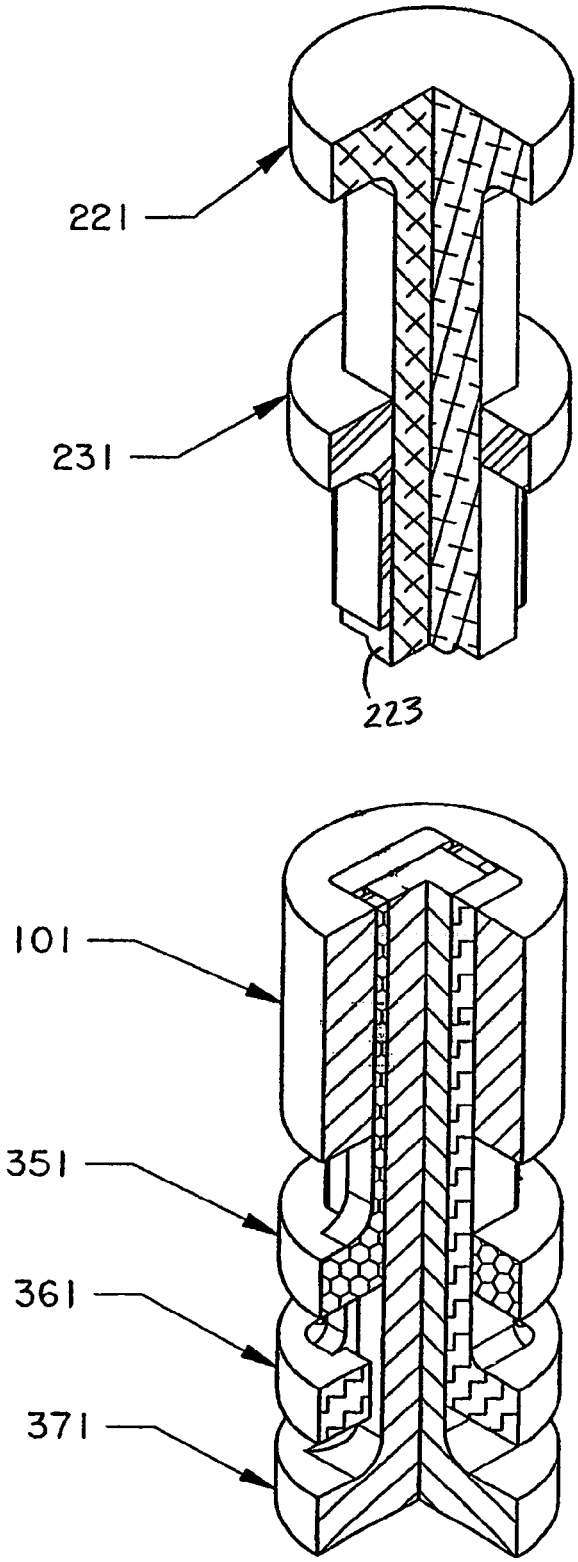
FIGS. 3*a-d* are perspective views of tooling for forming the powder metal component of FIG. 2*a*.
Figure 3B:
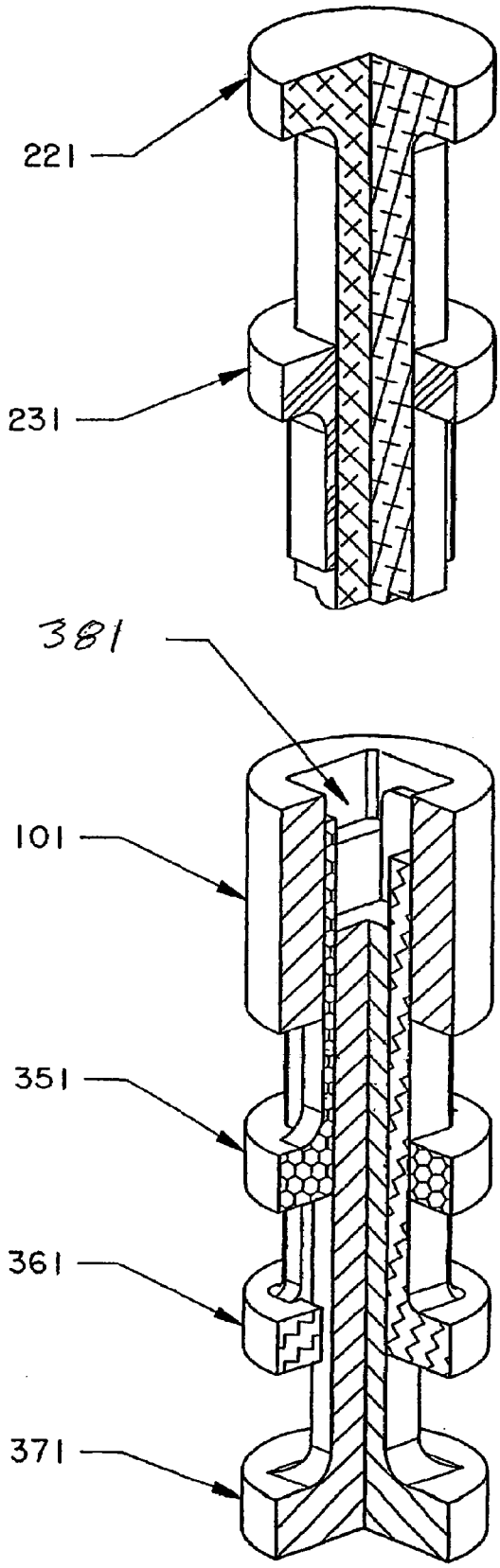

The second step, shown in FIG. 3*b*, is moving the tooling members 351, 361, and 371 relative to one another (and relative to the die 101 if necessary) to form a cavity 381 that forms the lower and outside surfaces of the component 25. This may occur by moving the punches 351, 361, and 371 down and/or moving the die 101 up. The upper and inside surfaces of the component 25 are formed by the lower ends of the punches 221 and 231, which also are slidable axially relative to one another.

Figure 3C:
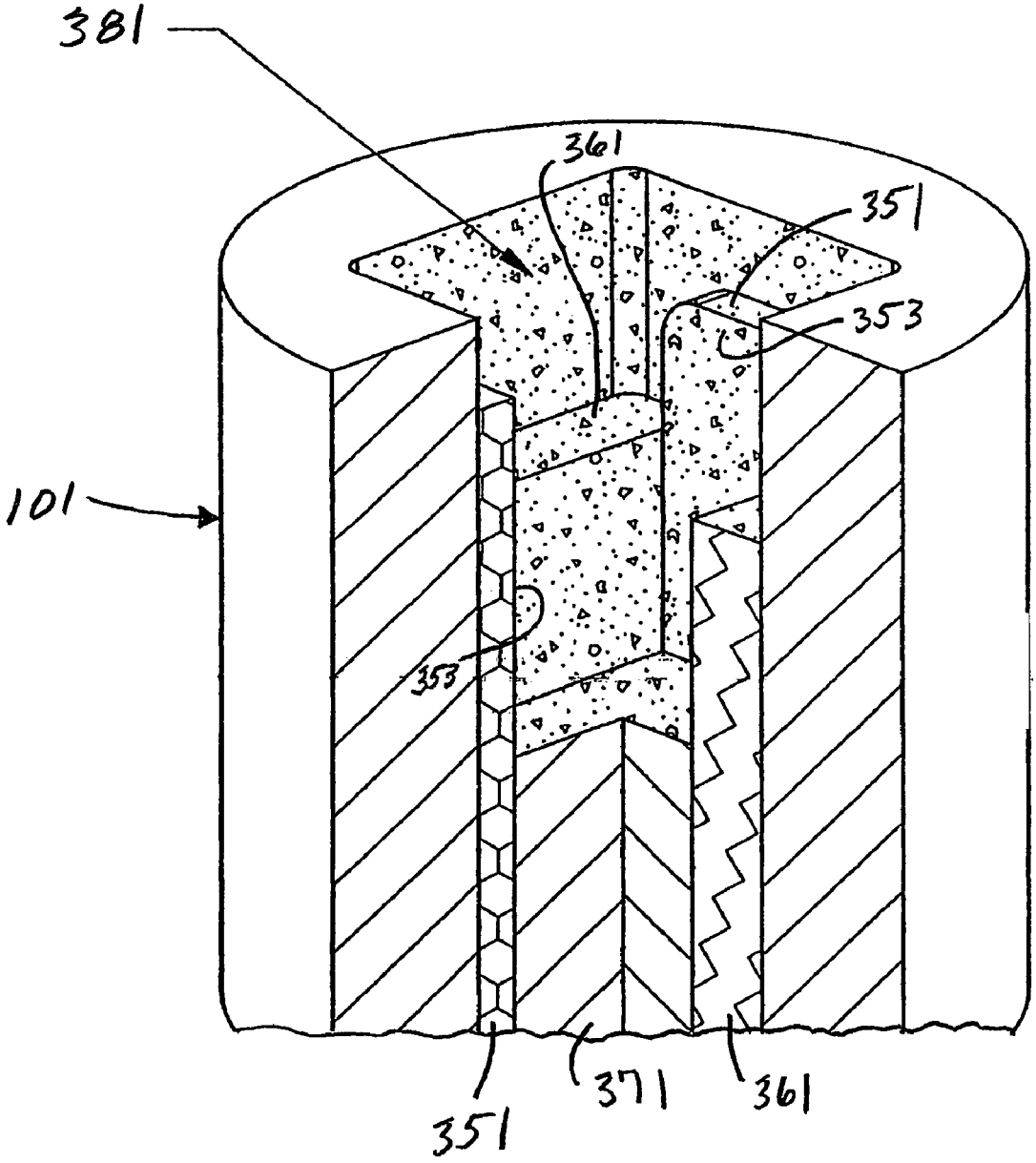

Next, in FIG. 3*c*, the third step is to fill the resulting cavity 381 with powder metal.

Figure 3D:
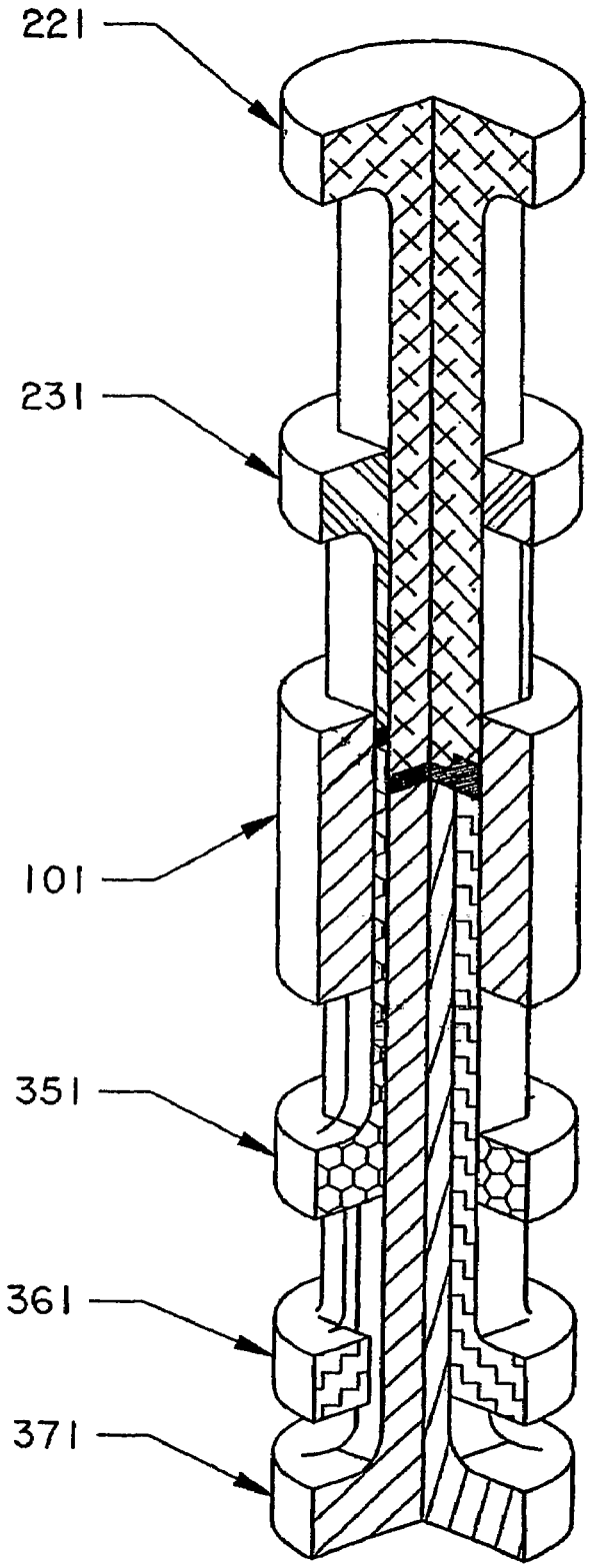

The fourth step, FIG. 3*d*, is to bring the tooling members 221 and 231 into the die 101 cavity 381 to begin compacting the powder from the top side, at the same time the tooling members 351, 361 and 371 will move relative to the die 101 compacting the powder from the bottom side, or from a different perspective the punches are moving toward each other compacting the powder between them contained in the cavity 381 by the die 101.

Figure 4:
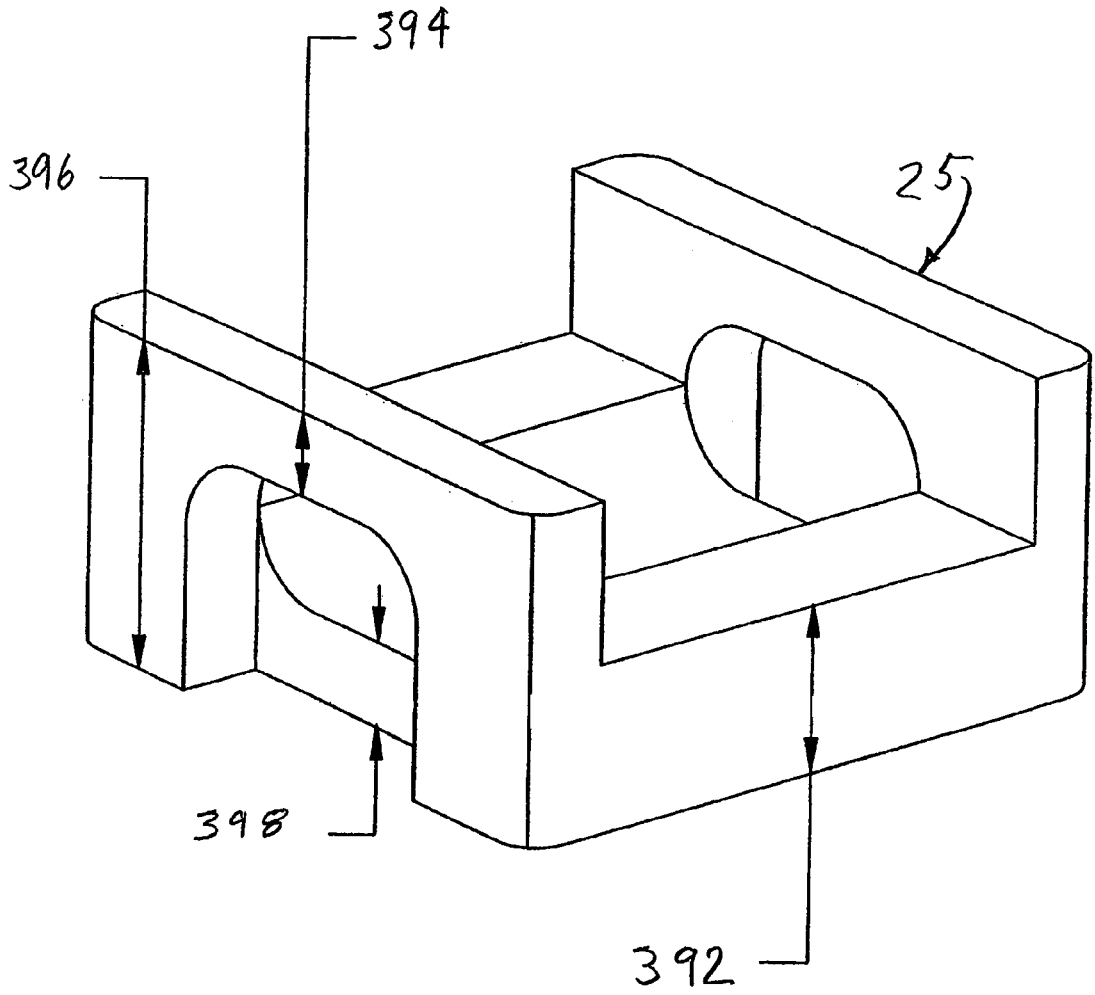
FIG. 4 is a view like FIG. 2*a* illustrating which areas of the component are formed by which areas of the tooling.

The fifth step is to continue moving the punches toward each other until the tooling member 231 passes tooling member 361. In this process powder is being compacted in four distinct zones. These zones, shown in FIG. 4, are as follows: zone 392 between tooling member 221 and tooling member 361; zone 394 between tooling member 231 and tooling member 351; zone 396 between tooling member 231 and tooling member 361; and zone 398 between tooling member 221 and tooling member 371.

Step six is for the tooling members 221 and 231 to move upward relative to and away from the lower tooling components 101, 351, 361 and 371.

The final step is for the remaining tooling, die 101 and tooling members 351, 361 and 371 to move relative to each other back to the starting position all level with each other as in FIG. 3(*a*), which ejects the compacted component 25.

Creation of the horizontal holes or slots occurred in the fourth and fifth step when the outer side surfaces 223 of the tooling member 221 passed by the inner side surfaces 353 of the tooling member 351 in close proximity, close enough to substantially evacuate any powder metal material that was against the surfaces 353 from the interface between the surfaces 223 and 353, and left the interface between the facing side faces of the two punches substantially free of powder. This area, having substantially no powder, but with powder being compacted above and to the sides of tooling member 351 and below tooling member 221, results in the slot 42 meeting the slots 26 and 27 with a void of material at the junction between the slot 42 and the slots 26 and 27, thereby creating holes 28 and 29 through the respective walls 44 and 46 of the component 25.

It is noted that the punches 361 and 371 are made as two separate pieces because the thickness of zone 398 is significantly different than the thickness of zone 392. Making the punches in two pieces enables filling the die in the area of the zone 398 uniformly with less powder metal material than the area of the zones 392. By the end of the compaction process of the final compact 25, however, the top of punch 371 is brought up to the level of the punch 361, since the component 25 is flat on the bottom.

The components 30 and 35 in FIGS. 2*b-d* illustrate other components that incorporate the invention. In those components, for each hole 51, one slot 53 is formed during compaction that opens in one direction (upwardly as viewed in FIGS. 2*b* and 2*d*) and a connecting slot 55 is formed that opens 180° opposite (downwardly as viewed in FIGS. 2*b* and 2*d*) from the direction the slot 43 opens. Each hole 51 is created by the substantial absence of powder material in the die cavity at the interface between the side surfaces of the two punches that form the respective slots 53 and 55. Since the component 35 has a flange 57, the inner slots 55 are formed by a punch that creates holes 59 (FIG. 2*c*) in the flange 57.

Preferred embodiments of the invention have been described in considerable detail. Many modifications and variations to the preferred embodiments described will be apparent to a person of ordinary skill in the art. For example, the powder metal components may have multiple holes or slots or many levels of complexity with additional holes also in the vertical direction intersecting those created in the horizontal direction. Therefore, the invention should not be limited to the embodiments described.

I claim:

1. A method of forming a powder metal compact for sintering, comprising the steps of:

providing a die set including a die having a cavity for receiving powder metal and containing said powder metal while it is being compacted into a compact, said die set including at least one punch movable into said die in a direction of compaction and out of said die in a direction of retraction along an axial direction, said die set being able to be opened to permit powder metal to be filled into said die and able to be closed when the powder metal previously filled into said die is compacted in said die, wherein when the die is closed, an interface surface of said punch that extends along said axial direction comes into sliding contact with another interface surface of an other member of said die set that extends along said axial direction at a face-to-face interface so as to create an absence of powder metal between said two surfaces at said face-to-face interface and create an opening through a wall of said compact in a direction perpendicular to the axial direction, said opening being defined by said face-to-face interface of said punch and said other member of said die set;

filling powder metal into said die;

closing said die set so as to create said face-to-face interface;

applying pressure to said powder metal within said die;

retracting said punch from said die; and ejecting said compact from said die.

2. The method of claim 1, wherein a surface of said punch extends along said axial direction in the direction of retraction from said interface surface of said punch and is continuous so as to form a surface of said compact adjacent to said opening and permit said punch to be retracted from said die after forming of said compact.

3. The method of claim 1, wherein powder metal is compacted on one side of said opening in a first direction of compaction and wherein powder metal is compacted on the other side of said opening in a second direction of compaction that is opposite, but coaxial, with the first direction of compaction.

4. The method of claim 1, wherein the axial direction is aligned with the direction of gravity.

5. The method of claim 1, wherein the opening is a hole.

6. The method of claim 5, wherein the hole extends substantially orthogonally to the direction of gravity.

7. The method of claim 1, wherein the opening joins a slot.

8. The method of claim 7, wherein the slot extends perpendicular to the direction of gravity.

9. The method of claim 1, wherein the other surface is on another punch.

10. The method of claim 9, wherein both punches are movable along the axial direction.

11. The method of claim 10, wherein the axial direction is aligned with the direction of gravity.

* * * * *

UNITED STATES PATENT AND TRADEMARK OFFICE

CERTIFICATE OF CORRECTION

PATENT NO. : 7,625,522 B2
APPLICATION NO. : 10/559699
DATED : December 1, 2009
INVENTOR(S) : Donald D. Cooper It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 724 days.

Signed and Sealed this

Second Day of November, 2010

David J. Kappos

David J. Kappos
*Director of the United States Patent and Trademark Office*